US005161706A

United States Patent [19]

Weinstein

[11] Patent Number: 5,161,706

[45] Date of Patent: Nov. 10, 1992

[54] TWIST AND PUSH SNAP-ON CHILD RESISTANT CAP

[75] Inventor: Jack Weinstein, Manchester Township, Ocean County, N.J.

[73] Assignee: Primary Delivery Systems, Inc., Easton, Pa.

[21] Appl. No.: 856,528

[22] Filed: Mar. 23, 1992

[51] Int. Cl.[5] ..... B65D 55/02

[52] U.S. Cl. ..... 215/223; 215/204; 215/208; 215/220; 215/221; 215/225; 215/301; 215/330

[58] Field of Search ..... 215/204, 208, 216, 217, 215/219, 220, 221, 222, 223, 224, 225, 301, 300, 334, 339

[56] References Cited

U.S. PATENT DOCUMENTS

| | | | |
|---|---|---|---|
| 2,964,207 | 12/1960 | Towns | 215/220 |
| 3,204,800 | 9/1965 | Bugla et al. | 215/223 |
| 3,432,065 | 3/1969 | Bugla | 220/301 |
| 3,716,161 | 2/1973 | Juuan et al. | 215/217 |
| 3,739,933 | 6/1973 | Degaetano | 215/217 X |
| 3,771,682 | 11/1973 | Chacos | 215/208 |
| 3,980,194 | 9/1976 | Costa | 215/223 |
| 4,049,148 | 9/1977 | Suhr et al. | 215/214 |
| 4,128,184 | 12/1978 | Northup | 215/222 |
| 4,157,142 | 6/1979 | Kong | 215/223 |
| 4,337,869 | 7/1982 | Guinle | 215/201 |
| 4,346,809 | 8/1982 | Kusz | 215/214 |
| 4,433,790 | 2/1984 | Gibson | 215/246 |
| 4,573,598 | 3/1986 | Perry | 215/204 |
| 4,832,218 | 5/1989 | Gibilisco | 215/220 |
| 4,991,729 | 2/1991 | Hunter | 215/206 |

*Primary Examiner*—Allan N. Shoap
*Assistant Examiner*—Vanessa Caretto
*Attorney, Agent, or Firm*—Kenneth P. Glynn

[57] ABSTRACT

A twist and push snap-on, child resistant cap and container has an inner cap seal which is easily snapped onto a neck of a container and an outer cap. The outer cap has a top and sidewalls and has a greater cross-sectional area than the inner cap, and receives and physically restrains the inner cap within the outer cap such that the inner cap may be moved upwardly and downwardly within it over specified distance. The outer cap includes a locking lug located on its inside wall adapted to snap over a circumferential bead located on the neck of the container. There is a stop located on the inside wall of the outer cap and is freely rotatable about the neck of the container except when in contact with stop(s) on the neck of the container at its level of rotation when the outer cap is on the container. A spring mechanism located between the inner and outer cap so as to bias downwardly the inner cap. There is a bead located circumferentially about its neck with a break to allow the lug and stop of the outer cap to pass therethrough. A first stop is located on the neck near but not above or below the opening in the bead and a second stop, larger than the first, is capable of preventing movement of the outer cap when rotated with its stop against its second stop.

12 Claims, 1 Drawing Sheet

TWIST AND PUSH SNAP-ON CHILD RESISTANT CAP

BACKGROUND OF THE INVENTION

1. Field of the Invention

The present invention is directed to a child resistant cap and container. More specifically, it is directed to a snap-on type child resistant cap and container. The child resistant cap and container of the present invention may be used in any industry where child resistance to opening a container is necessitated, such as pharmaceutical, over the counter medicines, caustic cleaners, materials containing high concentrations of harmful liquids, powders or otherwise.

2. Prior Art Statement

The present invention child resistant cap is based on a unique arrangements of components whereby the cap must be twisted in a specified direction and then pushed down and twisted further, then released up in order to be removed. There are literally thousands of prior art patents directed to various types of safety closures and some of these do provide for various types of movement with specified mechanisms, as follows:

U.S. Pat. No. 3,771,682 describes a safety bottle cap in which one or more detentes are guided through a labyrinth maze in order to arrive at a point where the cap can be removed from the neck of the bottle. The construction of the labyrinth is such that the cap must be moved in a manner quite unlike the manner in which is normally removed from a bottle. Thus, it may be that various rotations and pushing may be required to accomplish a completed path through a particular labyrinth. However, this does not operate in the same manner as the present invention nor does it use the same structure.

U.S. Pat. No. 4,337,869 is directed to a closure assembly which has two separable closure members which are pre-assembled in coaxially stacked relationship, with their tops aligned in the same direction. The lower closure member of the stack assembly has locking elements which are engagable with cooperating locking elements on the container, thereby providing a child resistant closure. The upper closure is a simple snap cap, plug cap or other closure which is not child resistant. The upper closure is removably attached to the lower child resistant closure by an interference fit between the resilient attachment members integrally formed as parts of the upper and lower closures. The assembly can be separated so that the upper piece may be used without the lower piece to render the closure non child resistant rather than child resistant. The child resistant mechanism includes the use of downwardly opening notches and receiving keys with a lug with slanted camming surfaces.

U.S. Pat. No. 4,573,598 describes a child resistant package with a tamper indicating device. This includes a snap-on closure with a container having a neck finish which includes annular retaining bead having at least one notch and a closure having a top and a peripheral skirt. The skirt has a lifting tab of the outer surface and a first radially inwardly extending locking lug on the inner surface adjacent the external lifting tab. A cover cap having a top wall and a peripheral wall placed over the closure and the peripheral wall of the cover surrounds the peripheral skirt of closure. An annular band is connected to the lower edge of the peripheral wall of the cover cap by weakened portions. The band includes a plurality of circumferentially spaced radially inwardly extending lugs that project beneath the free edge of the peripheral skirt of closure so that the cover can not be removed until the band is first removed by severing it from the closure cap. The band normally obscures the view of the indicia on the container that indicates proper alignment of the lug on the closure with the notch on the container. The cover cap normally obscures the view of the construction and indicia on the closure.

U.S. Pat. No. 4,832,218 describes a child resistant closure device for a closable container which, at its users option, can be used as a child resistant cap or one which is non child resistant. An outer cap rotatably and slidably engages an inner cap that directly closes a container with an intermediate element biasing the outer and inner caps apart from each other but formed so as to take up a first position in which an axially applied force by the user temporarily non-rotatably couples the inner and outer caps for child resistant operation, and an axially applied force on the intermediate element coupled with a partial turning of the outer cap relative thereto causes permanent nonrotatable engagement between the outer and inner caps through the intermediate element to make the safety closure non child resistant.

U.S. Pat. No. 4,991,729 describes an elder-accessible child resistant container which involves rotation and lifting through a plurality of ribs to enable the user to open the closure. This is sometimes referred to as a combination lock cap as the proper rotational positionings must be achieved in order to open the container.

Notwithstanding the prior art, it is believed that the present invention is neither taught nor rendered obvious.

SUMMARY OF THE INVENTION

The present invention is a twist and push snap-on, child resistant cap and container. There is an inner cap seal, e.g. disk or physical land seal which may be easily snapped onto the top of a neck of a container and an outer cap. The outer cap has a top and sidewalls and has a greater cross-sectional area than the inner cap. It has means for receiving and physically restraining the inner cap within the outer cap such that the inner cap may be moved upwardly and downwardly within the outer cap over specified distance but so that the inner cap cannot be removed from the outer cap. The outer cap also includes a locking lug which is located on its inside wall and is adapted to snap over a circumferential bead which is located on the neck of the container. Finally, it also includes a stop which is located on the inside wall of the outer cap which is adapted to freely rotate about the neck of the container except when in contact with one or more stops on the neck of the container at its level of rotation when the outer cap is on the container. There is also a spring mechanism located between the inner and outer cap so as to bias downwardly the inner cap. This spring may be connected to either the outer or inner cap or may be a free spring located there between. The container has an open neck and is adapted at the top of the open neck to receive the inner cap and further has a bead located circumferentially about the neck of the container which has a break or opening located therein to allow the lug and stop of the outer cap to pass therethrough. It also includes a first stop located on the neck at a location near but not above or below the opening in the bead and a second stop being larger than the first stop, the second stop being capable of preventing movement of the outer cap when the outer cap is rotated with its stop against its second stop whether or not said outer cap is pushed downwardly or upwardly with respect to the spring bias.

BRIEF DESCRIPTION OF THE DRAWINGS

The present invention will be more fully understood when the specification herein is taken in conjunction with the drawings appended hereto. These drawings are.

DETAILED DESCRIPTION OF THE PRESENT INVENTION

The present invention involves a twist and push, child resistant cap which is of the snap-on type, and a container adapted to interact therewith. Generally, containers such as pill containers, certain liquid containers and the like involve snap-on caps which may be put on and off rather easily. While this is of great convenience to the user, it also enables children to open such caps and containers and to expose them to potentially harmful contents.

It is an object of the present invention to create a unique snap-on cap and container which is both child proof and easy to use. It is also an object of the present invention to create such a cap and container which would not create difficulties in opening for people who are slightly handicapped or lack total manual dexterity. In other words, it is an object to provide a cap and container which could easily be opened by someone who may be arthritic or otherwise may have difficulty opening known child resistant caps. Finally, it an object of the present invention to create a child resistant cap and container wherein the cap is required to go through four separate steps for opening, namely, rotation or twisting, followed by pushing down, followed by more rotation or twisting, and finally, lifting up.

Figure 1:
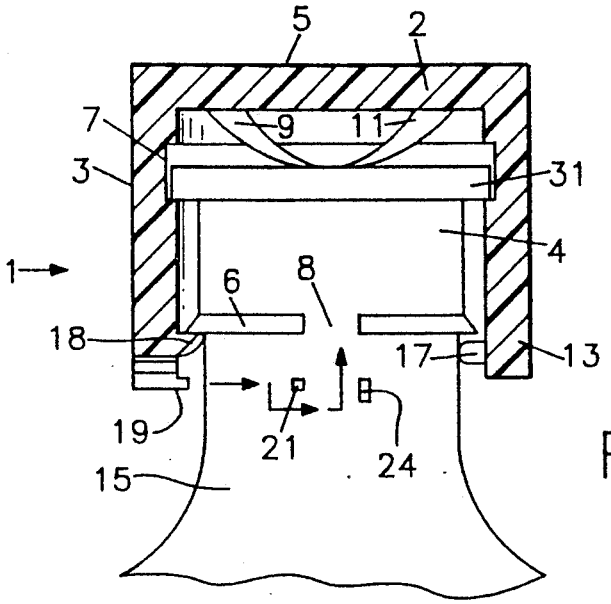
FIG. 1, which shows a front view of a present invention cap and container with the outer cap being cut.

Referring now to FIG. 1, there is shown container and cap system 1 which includes container 15 with container neck 4 and an opening (not shown). On container 15 is outer cap 2 and inner cap 31. Outer cap 2 includes top 5 and sidewalls 3. As can be seen, sidewall 3 includes a cut-out section 7 which comprises a means for receiving and physically restraining inner cap 31 within outer cap 2 such that inner cap 31 may be moved upwardly and downwardly within cut-out 7. As a practical matter, outer cap 2 and inner cap 31 are manufactured separately and inner cap 31 is permanently snapped into its cut-out 7 of outer cap 2. Container 15 has a circumferential bead 6 located about neck 4 and this includes a break or opening 8, as shown. Not shown in this particular embodiment would be a second opening in bead 6 which would be located perhaps on the opposite side from opening 8. At least one break or opening is located in the circumferential bead and more than one, as in this case, may be utilized. Outer cap 2 at the lower portion of its sidewall 3 includes a locking lug 17 and a second locking lug 18. One or two or three or more such lugs may be included in the outer cap and should be designed to align with a corresponding number and location of openings such as opening 8 in bead 6. If more than one lug is utilized, they should preferably be of different widths or configurations and only correspond to a single particular opening for a single position of cap removal about the circumference of the bottle neck.

There is also included on the inside of sidewall 3 a stop 19 which may comprise only a small portion of the circumference of the inside of outer cap 2 and must be of small enough width to pass through opening 8. Container 15 has two container stops. A first stop 21 is located thereon as shown near but not above or below the opening 8 in circumferential bead 6. As shown, this first stop is at the same level or height from the base of the bottle as outer cap stop 19. When outer cap 2 is rotated in the position shown in FIG. 1, it cannot be opened because outer cap stop 19 will hit first container stop 21 and will not be able to bypass it without complex motion and cannot bypass it merely by rotation.

Container 15 also includes a second stop 24 which is larger than first stop 21 and is capable of preventing movement of outer cap 2 even when outer cap 2 is rotated and depressed at the same time. Thus, outer cap 2 must be rotated in the predetermined direction (per drawings counterclockwise) until outer cap stop 19 runs into or hits container stop 21. At this point the user presses down, rotates further to get under the container stop 21 and past container stop 21, then lifts up to pass both lug 18 and stop 19 through opening 8 in circumferential bead 6 to remove the outer and inner caps together. Typically, the user rotates outer cap 2 beyond first container stop 21 until lug 19 will hit or stop at second container stop 24 and this will be the point at which the user may lift up for opening.

Also shown in FIG. 1 are spring leaf 9 and spring leaf 11. Here, they are integrally molded and form a part of the under side of top 5 of outer cap 2. Alternatively, they could be connected to the top of inner cap 31.

Figure 2:
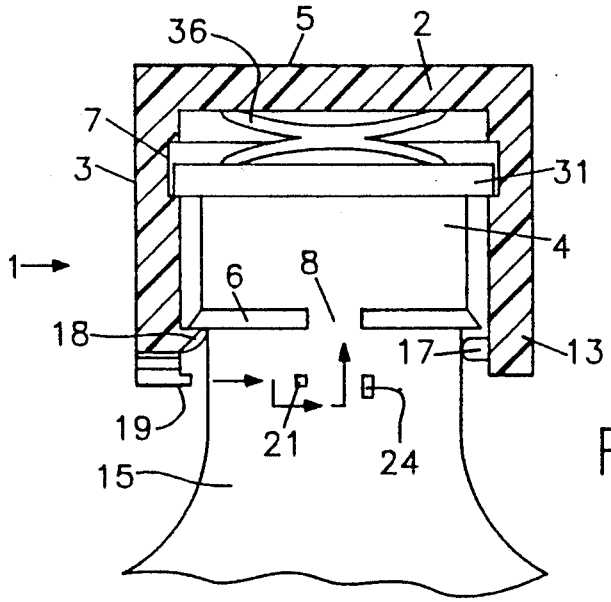
FIG. 2, which shows a front view of an alternative embodiment present invention cap and container with the outer cap shown in a cut view; and, FIG. 3, which shows a top cut view looking down into an outer cap of a present invention child resistant cap and container system.

Referring to FIG. 2, there is shown a configuration similar to the configuration shown in FIG. 1 wherein like parts have been like numbered and the common components need not be repeated in detail here. However, in FIG. 2, in place of leaf springs 9 and 11 is a free floating spider spring 36 which is molded separately from outer cap 2 and inner cap 31. During assembly, spider spring 36 is dropped into the outer cap 2 while it is upside down and inner cap 31 is then snapped into place.

In both FIGS. 1 and 2, it can be seen that the spring is utilized to bias the outer cap 2 in an upward position relative to the inner element 31. Thus, while in use, when the cap is snapped on, both the inner cap and outer cap are pressed downwardly and the inner element will engage and seal the container. The outer cap does not seal the container but merely acts as a child resistant safety outer cap. Thus, during normal manipulations of a child such as rotation or pulling or even pushing on the cap, only the outer cap will move and the inner cap cannot and will not be removed from the top of the container until the proper sequences of twist, push, twist and lift are performed.

Figure 3:
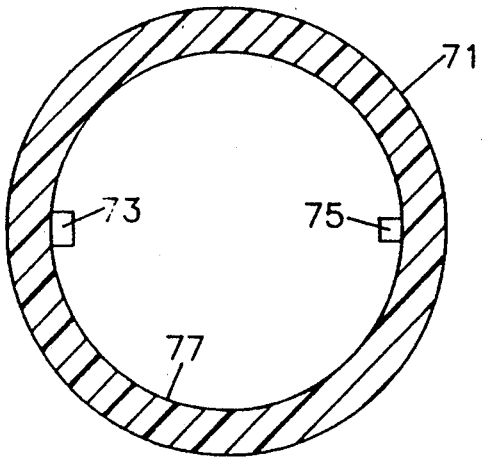

FIG. 3 shows an outer cap 71 which is a top, cut view. In this embodiment, lugs 73 and 75 attached to sidewall 77 are opposite one another but are of significantly different widths, as shown. A corresponding circumferential bead will have one wider opening and one narrower opening and will permit cap removal only in one position when used in conjunction with the other features as described in relation to FIGS. 1 and 2 above.

Obviously, numerous modifications and variations of the present invention are possible in light of the above teachings. It is therefore understood that within the scope of the appended claims, the invention may be practiced otherwise than as specifically described herein.

What is claimed is:

1. A twist and push snap-on child resistant cap and container which comprises:

(a) an inner cap which may be easily snapped onto a neck of a container;

(b) an outer cap having a top and sidewalls, said top and sidewalls having an inside and an outside, said outer cap having a greater cross-section than the inner cap and having means for receiving and physically restraining the inner cap within said outer cap such that said inner cap may be moved upwardly and downwardly within said outer cap over a specified distance but so that said inner cap cannot be removed from said outer cap, said outer cap further including a locking lug located on the inside of said sidewalls adapted to snap over a circumferential bead located on a neck of a container and further including a stop also located on the inside of said sidewalls of said outer cap adapted to freely rotate about a neck of a container except when in contact with at least one stop on a neck of a container at a predetermined level of rotation when said outer cap is on said container;

(c) a spring mechanism located on the inside of said top of said outer cap and above said inner cap so as to create a spring bias downwardly so that said inner cap and outer cap may be moved up and down relative to one another;

(d) a container having an open neck and adapted at a top of said open neck to receive said inner cap and further having a bead located circumferential about the neck of said container and having a break or opening located in said bead to allow said lug and said stop on said outer cap to pass therethrough, and further including a first stop located on said neck at a location adjacent to and axially non-aligned with said opening in said bead and a second stop being larger than said first stop, said second stop being capable of preventing rotation of said outer cap when its stop is against said second stop whether or not said outer cap is pushed downwardly or upwardly with respect to said spring bias.

2. The child resistant cap and container of claim 1, wherein said means for receiving and physically restraining the inner cap constitutes a cut-out or groove located within said inside of said sidewall of said outer cap.

3. The child resistant cap and container of claim 1, wherein said spring mechanism is physically attached to the outer cap.

4. The child resistant cap and container of claim 3, wherein said means for receiving and physically restraining the inner cap constitutes a cut-out or groove located within said inside of said sidewall of said outer cap.

5. The child resistant cap and container of claim 1, wherein said spring mechanism is physically connected to the inner cap.

6. The child resistant cap and container of claim 2, wherein said spring mechanism is physically connected to the inner cap.

7. The child resistant cap and container of claim 1, wherein two or more lugs are utilized on said inside of said sidewall of said outer cap and a corresponding number of breaks or openings are located in the circumferential bead of the container.

8. The child resistant cap and container of claim 7, wherein said means for receiving and physically restraining the inner cap constitutes a cut-out or groove located within said inside of said sidewall of said outer cap.

9. The child resistant cap and container of claim 7, wherein said spring mechanism is physically attached to the outer cap.

10. The child resistant cap and container of claim 9, wherein said means for receiving and physically restraining the inner cap constitutes a cut-out or groove located within said inside of said sidewall of said outer cap.

11. The child resistant cap and container of claim 7, wherein said spring mechanism is physically connected to inner cap.

12. The child resistant cap and container of claim 8, wherein said spring mechanism is physically connected to the inner cap.

* * * * *